US011859633B2

(12) United States Patent
Lin et al.

(10) Patent No.: US 11,859,633 B2
(45) Date of Patent: Jan. 2, 2024

(54) CENTRIFUGAL FAN

(71) Applicant: ASUSTEK COMPUTER INC., Taipei (TW)

(72) Inventors: Hsin Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/859,797

(22) Filed: Jul. 7, 2022

(65) Prior Publication Data

US 2023/0167828 A1 Jun. 1, 2023

(30) Foreign Application Priority Data

Nov. 26, 2021 (TW) ..... 110144203

(51) Int. Cl.

| | |
|---|---|
| ***F04D 29/30*** | (2006.01) |
| ***F04D 29/28*** | (2006.01) |
| ***F04D 29/44*** | (2006.01) |
| ***F04D 17/16*** | (2006.01) |

(52) U.S. Cl.

CPC ..... *F04D 29/281* (2013.01); *F04D 29/30* (2013.01); *F04D 29/441* (2013.01)

(58) Field of Classification Search

CPC ..... F04D 29/30; F04D 29/281; F04D 29/441; F04D 29/4226; F04D 17/16

See application file for complete search history.

(56) References Cited

FOREIGN PATENT DOCUMENTS

| | | | | | |
|---|---|---|---|---|---|
| CN | 100582492 | C | | 1/2010 | |
| CN | 101319686 | B | | 11/2011 | |
| CN | 111927823 | A | * | 11/2020 | |
| TW | I427220 | B | | 2/2014 | |
| WO | WO-2013051297 | A1 | * | 4/2013 | ..... F04D 17/04 |

OTHER PUBLICATIONS

English translation of CN 111927823 by PE2E Nov. 1, 2022.*
English translation of WO 201351297 by PE2E Nov. 1, 2022.*

* cited by examiner

*Primary Examiner* — Deming Wan

(74) *Attorney, Agent, or Firm* — Muncy, Geissler, Olds & Lowe, P.C.

(57) ABSTRACT

Provided is a centrifugal fan. The centrifugal fan includes an air inlet, a shaft, and a plurality of blades. The blades are arranged around the shaft. Each of the blades includes an air guiding portion on a side of the blade facing the air inlet. The air guiding portion includes a first curve and a second curve. An air inflow channel is formed between the first curve and the second curve of two adjacent air guiding portions respectively. A width of the air inflow channel is expanded in a direction away from the air inlet according to an expanding ratio.

7 Claims, 10 Drawing Sheets

CENTRIFUGAL FAN

CROSS-REFERENCE TO RELATED APPLICATION

This application claims the priority benefit of Taiwan application serial No. 110144203, filed on Nov. 26, 2021. The entirety of the above-mentioned patent application is hereby incorporated by reference herein and made a part of the specification.

BACKGROUND OF THE INVENTION

Field of the Invention

The disclosure relates to a fan, and in particular, to a centrifugal fan for an electronic device.

Description of the Related Art

A centrifugal fan is formed by a plurality of blades arranged in a ring shape. When the fan runs, airflow is sucked from an air inlet, and flows in a centrifugal direction through channels between the blades.

Generally, the performance of the fan is adjusted by changing the design of a blade curve and the number of blades. However, in the conventional art, during the design of the blade curve of the fan, an airflow phenomenon that occurs when airflow enters a space between the blades from the air inlet is not taken into consideration, and vortexes tend to occur. As a result, the performance of the fan is reduced, and a large amount of airflow noise is generated.

BRIEF SUMMARY OF THE INVENTION

The disclosure provides a centrifugal fan. The centrifugal fan includes an air inlet, a shaft, and a plurality of blades. The blades are arranged around the shaft. Each of the blades includes an air guiding portion on a side of the blade facing the air inlet. The air guiding portion includes a first curve and a second curve. An air inflow channel is formed between the first curve and the second curve of two adjacent air guiding portions respectively. A width of the air inflow channel is expanded in a direction away from the air inlet according to an expanding ratio.

Through the centrifugal fan provided in the disclosure, the blade of the centrifugal fan includes the air guiding portion on a side of the blade facing the air inlet, and the air inflow channel between the adjacent air guiding portions is evenly expanded in the direction away from the air inlet according to an expanding ratio. Therefore, the airflow phenomenon at the air inflow channel is effectively mitigated, to enhance the performance of the fan and reduce airflow noise.

DETAILED DESCRIPTION OF THE EMBODIMENTS

More detailed descriptions of the specific embodiments of the disclosure are provided below with reference to the accompanying drawings. The features and advantages of the disclosure are described more clearly according to the following description and claims. It should be noted that all of the drawings use very simplified forms and imprecise proportions, only being used for assisting in conveniently and clearly explaining the objective of the embodiments of the disclosure.

Figure 1:
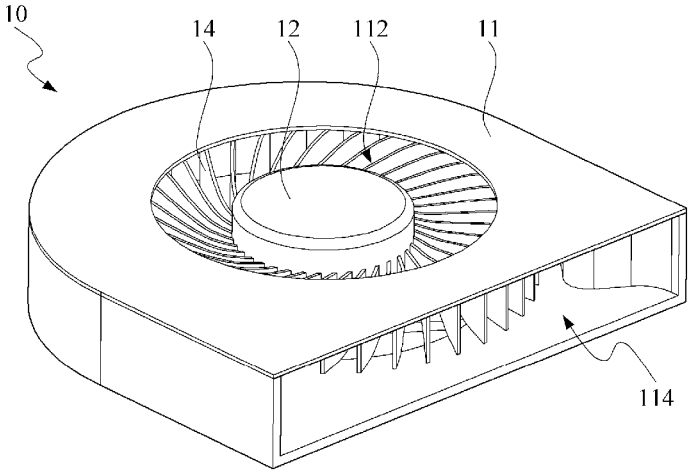
FIG. 1 is a schematic perspective view of an embodiment of a centrifugal fan according to the disclosure.

FIG. 1 is a schematic perspective view of an embodiment of a centrifugal fan according to the disclosure. A centrifugal fan 10 is applicable to an electronic device such as a notebook computer, a desktop computer, or a mainboard, to improve heat dissipation efficiency of the electronic device.

As shown in the figure, the centrifugal fan 10 includes a case 11, a shaft 12, and a plurality of blades 14. The case 11 includes an air inlet 112 and an air outlet 114. The blades 14 are arranged around the shaft 12, and form a fan blade module as a whole.

Figure 2:
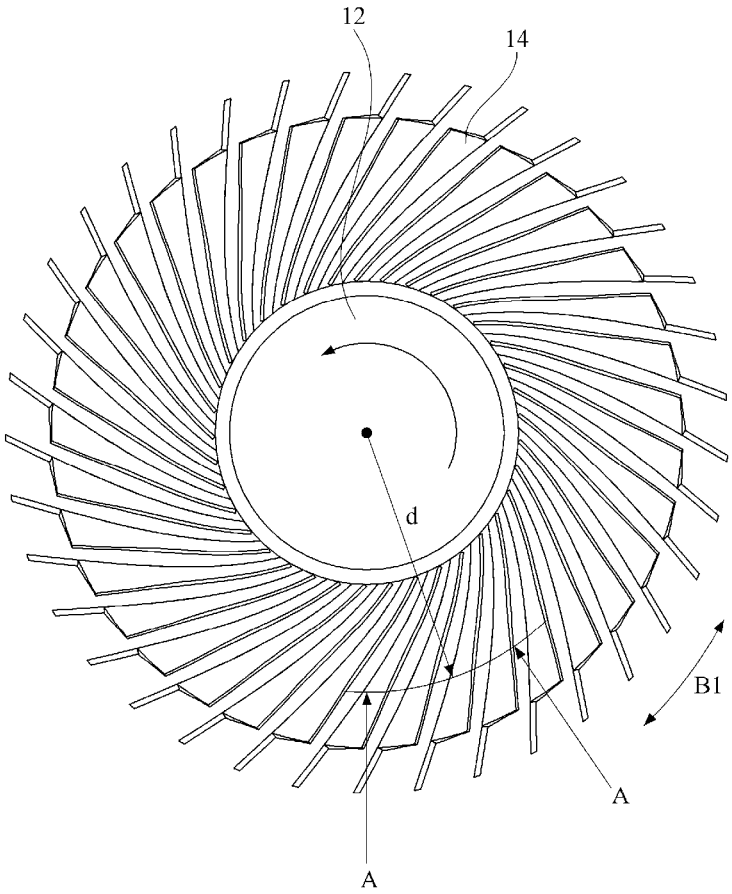
FIG. 2 is a schematic top view of an embodiment of a fan blade module in FIG. 1.
Figure 3:
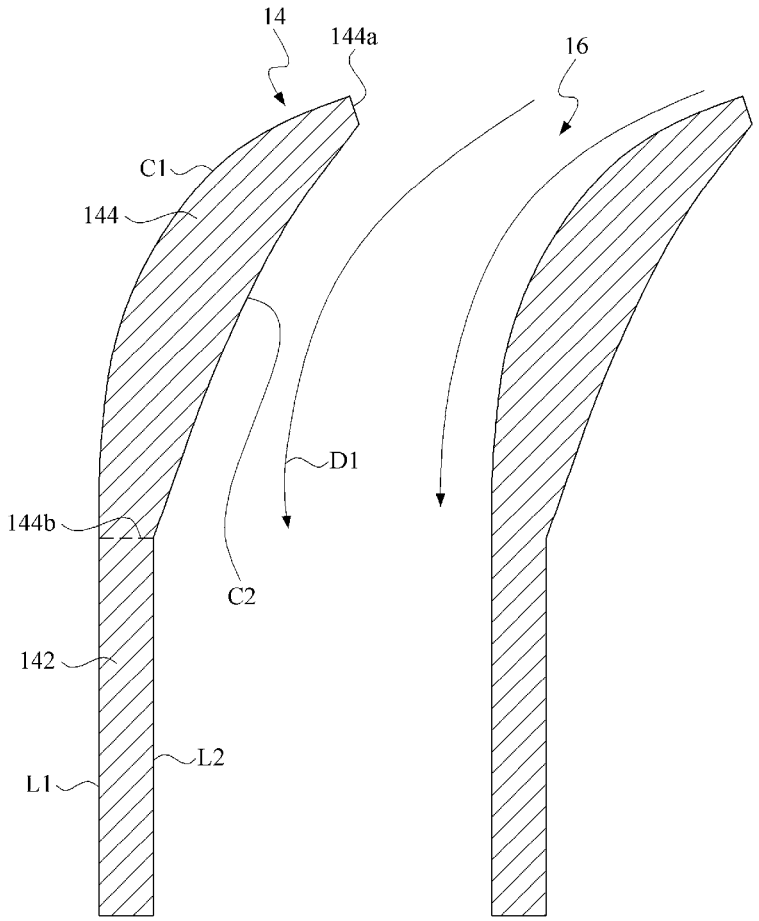
FIG. 3 is a schematic cross-sectional view corresponding to a cross section A-A in FIG. 2.

FIG. 2 is a schematic top view of an embodiment of the fan blade module in FIG. 1, and FIG. 3 is a schematic cross-sectional view corresponding to a cross section A-A in FIG. 2. The cross section A-A in FIG. 3 is a cross section in a circumferential direction B1 of the fan blade module and at a position located at a preset distance d from an axial center of the shaft 12.

The blade 14 includes a non-air guiding portion 142 and an air guiding portion 144. The air guiding portion 144 is connected to the non-air guiding portion 142, and is located on a side of the non-air guiding portion 142 facing the air inlet 112, that is, an upper side in the figure. In an embodiment, the blade 14 includes the air guiding portion 144 in a range corresponding to the air inlet 112, to guide airflow from the air inlet 112. Arrows in the figure show an airflow direction D1 of the airflow from the air inlet 112.

The non-air guiding portion 142 includes a first straight line L1 and a second straight line L2 along the cross section in the circumferential direction B1. The air guiding portion 144 includes a first curve C1 and a second curve C2 along the cross section in the circumferential direction B1. The first curve C1 and the first straight line L1 are located on a leeward side of the blade 14. The second curve C2 and the second straight line L2 are located on a windward side of the blade 14.

The first straight line L1 is parallel to the second straight line L2, to form the non-air guiding portion 142 having a fixed thickness. The first straight line L1 is connected to the first curve C1 and tangent to the first curve C1. The second straight line L2 is connected to the second curve C2. However, the second curve C2 is different from the first curve C1. In an embodiment, a curvature radius of the second curve C2 is greater than a curvature radius of the first curve C1. A cross section of the air guiding portion 144 presents, as a whole, a structure in which a central part is thick and two ends are thin.

An air inflow channel 16 is formed between two adjacent air guiding portions 144. The air inflow channel 16 is defined by a first curve C1 of an air guiding portion 14 and a second curve C2 of an adjacent air guiding portion 14.

The air inflow channel 16 is expanded in the airflow direction D1 according to an expanding ratio. That is, the air inflow channel 16 is expanded in a direction away from the air inlet 112. The air inflow channel 16 is expanded in the above manner to avoid or slow down a drastic change of airflow filling the space, and to achieve the purpose of reducing or eliminating a vortex phenomenon. A design process of the blade 14 in the disclosure is described in more detail in the subsequent paragraphs corresponding to FIG. 4A to FIG. 4D.

In an embodiment, the air guiding portion 144 includes a front edge 144*a* and a rear edge 144*b*. The front edge 144*a* is an end of the air guiding portion 144 facing the air inlet 112, and the rear edge 144*b* is an end of the air guiding portion 144 connected to the non-air guiding portion 142. A thickness of the front edge 144*a* is less than a thickness of the rear edge 144*b*, to ensure that the entire blade 14 has enough strength.

FIG. 4A to FIG. 4D show a design process of blades in the disclosure based on a specified first curve.

Figure 4A:
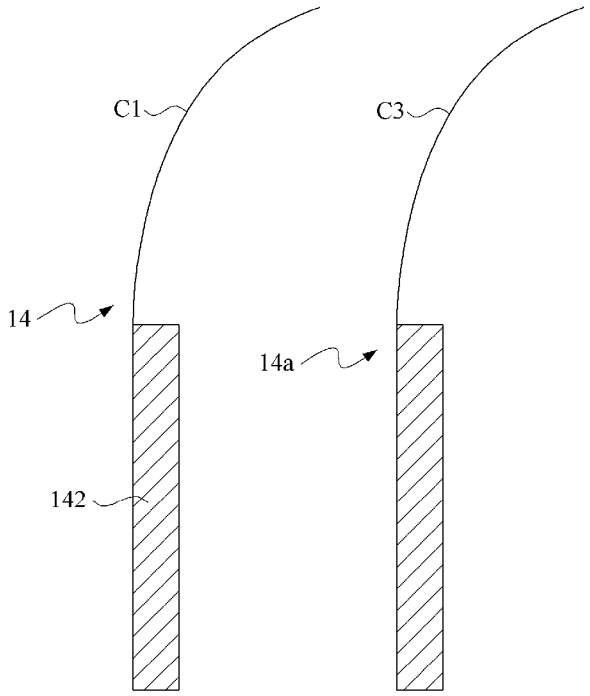
FIG. 4A to FIG. 4D show a design process of blades in the disclosure based on a specified first curve.

First, as shown in FIG. 4A, one first curve C1 of the blade 14 is provided, and a third curve C3 of an adjacent blade 14*a* is constructed using the first curve C1. The first curve C1 is a basic line type for blade design. The first curve C1 and the third curve C3 are curves located on leeward sides of the blades 14 and 14*a*.

Figure 4B:
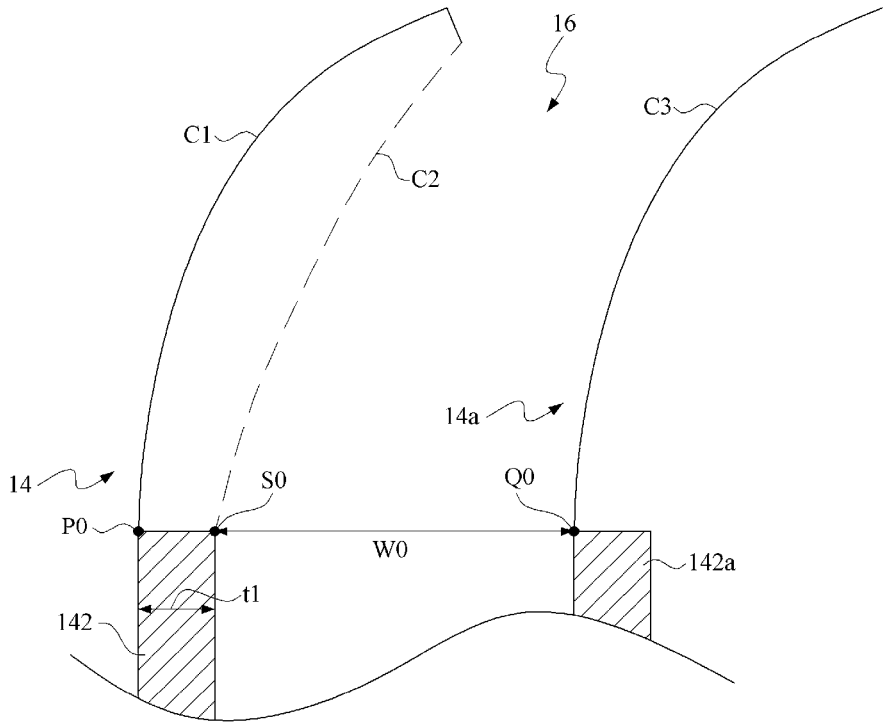

Next, as shown in FIG. 4B, a thickness t1 of the non-air guiding portion 142 is specified. By using a starting point P0 of the first curve C1 and the thickness t1 of the non-air guiding portion 142, a starting point S0 of the second curve C2 and an exit width W0 of the air inflow channel 16 are obtained. The starting point P0 of the first curve C1 is a connecting point at which the first curve C1 and the non-air guiding portion 142 are connected. The starting point S0 of the second curve C2 is a connecting point at which the second curve C2 and the non-air guiding portion 142 are connected. A starting point Q0 of the third curve C3 is a connecting point at which the third curve C3 and the non-air guiding portion 142*a* are connected. The exit width W0 is a width of the air inflow channel 16 at a position close to the non-air guiding portion 142.

Figure 4C:
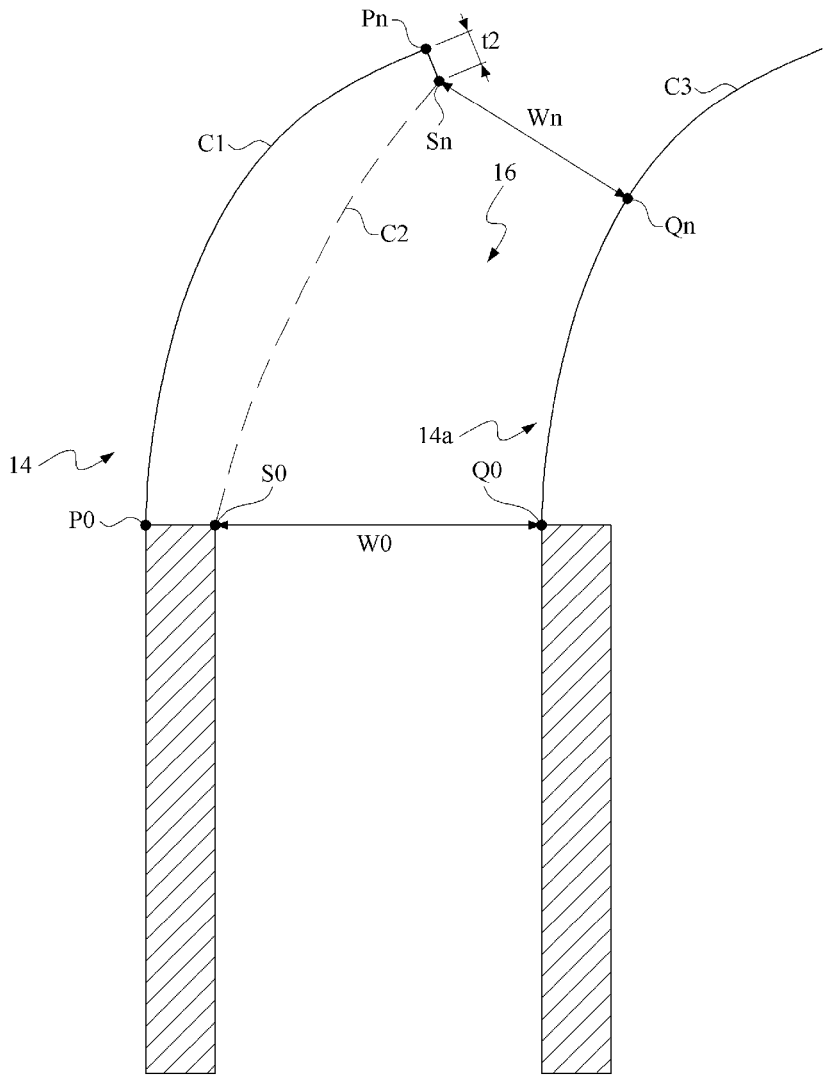

Subsequently, as shown in FIG. 4C, a thickness t2 of the front edge 144*a* of the air guiding portion 144 is specified. A terminal point Sn of the second curve C2 is constructed using a terminal point Pn of the first curve C1. By using the terminal point Sn of the second curve C2 and the third curve C3, an entrance width Wn of the air inflow channel 16 and a closest point Qn on the third curve C3 closest to the terminal point Sn of the second curve C2 are obtained.

Figure 4D:
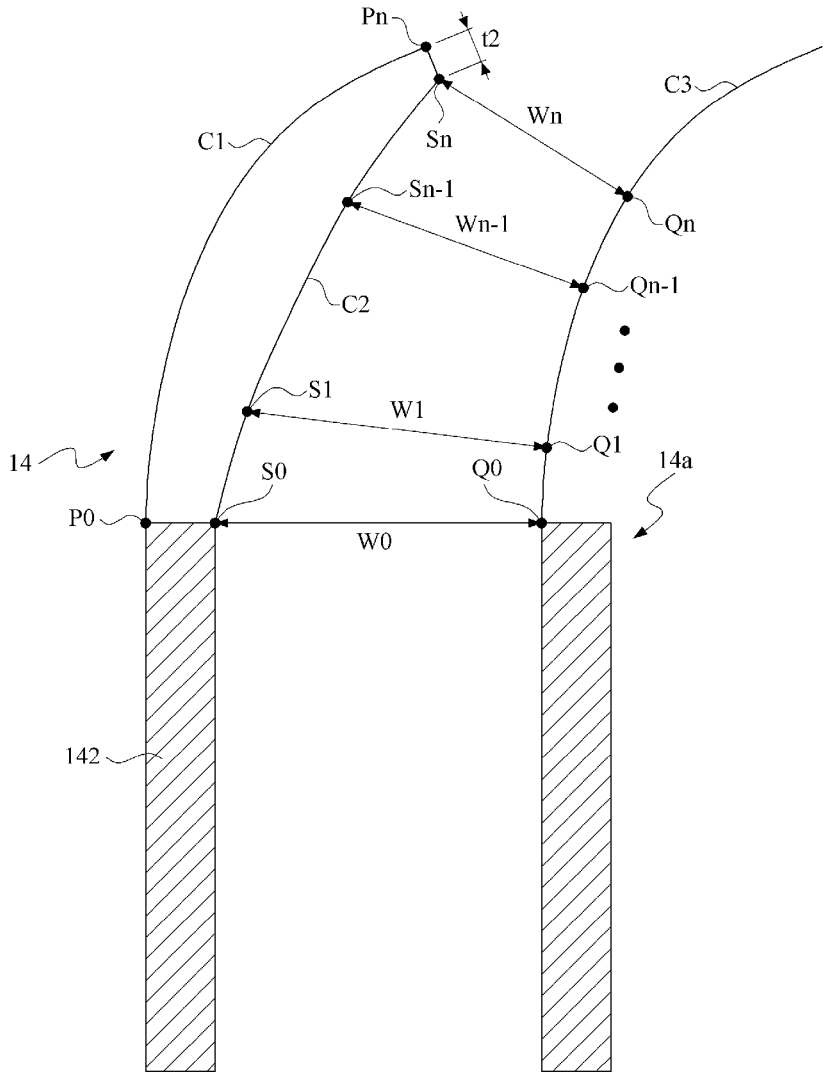

Next, as shown in FIG. 4D, between the starting point Q0 of the third curve C3 and the foregoing closest point Qn, a plurality of nodes Q1, . . . , Qn−1 are defined along the third curve C3. Since the exit width W0 and the entrance width Wn of the air inflow channel 16 are known, width values W1, . . . , Wn−1 corresponding to the respective nodes Q1, . . . , Qn−1 are calculated by using a linear interpolation method.

Subsequently, nodes S1, . . . , Sn−1 on the second curve C2 are constructed by using positions of the nodes Q1, . . . , Qn−1 on the third curve C3 and the corresponding width values W1, . . . , Wn−1. In an embodiment, an expansion is performed from the nodes Q1, . . . , Qn−1 on the third curve C3 in a normal direction of the third curve respectively by distances corresponding to the width values W1, . . . , Wn−1, to obtain the nodes S1, . . . , Sn−1. These nodes S1, . . . , Sn−1 construct a line type of the second curve C2. A complete blade 14 is constructed by combining a line type of the first curve C1 and the line type of the second curve C2 with the non-air guiding portion 142 having a known thickness.

Figure 5:
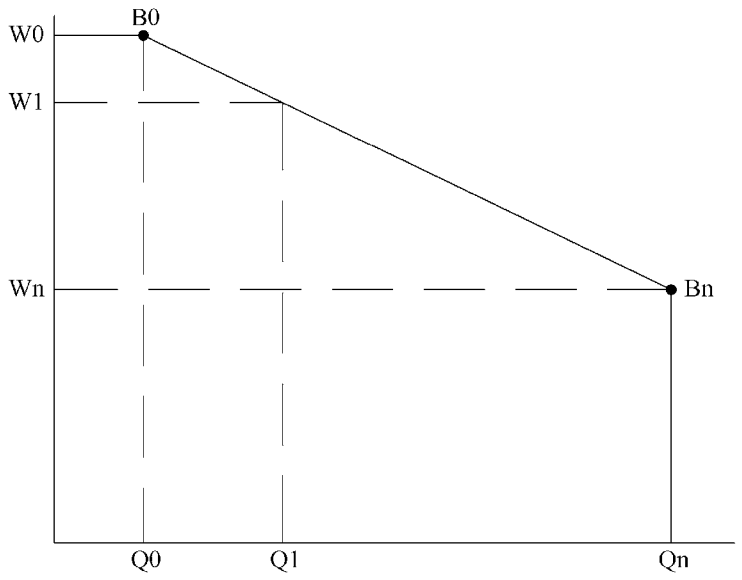
FIG. 5 is a chart showing a linear interpolation method used in FIG. 4D.

FIG. 5 is a chart showing a linear interpolation method used in FIG. 4D. A horizontal axis in the chart indicates distances from the starting point Q0 of the third curve C3 to the nodes Q1, . . . , Qn−1 between the starting point Q0 and the closest point Qn. A vertical axis of the chart indicates the width values W1, . . . , Wn−1. A point Bn corresponds to the closest point Qn of the third curve C3, and a width value at the point Bn is the entrance width Wn. A point B0 corresponds to the starting point Q0 of the third curve C3, and a width value at the point B0 is the exit width W0. The width values corresponding to the respective nodes Q1, . . . , Qn−1 are obtained by a linear interpolation method using a connecting line between the point Bn and the point B0. A slope of the connecting line is the expanding ratio of the air inflow channel 16.

Figure 6:
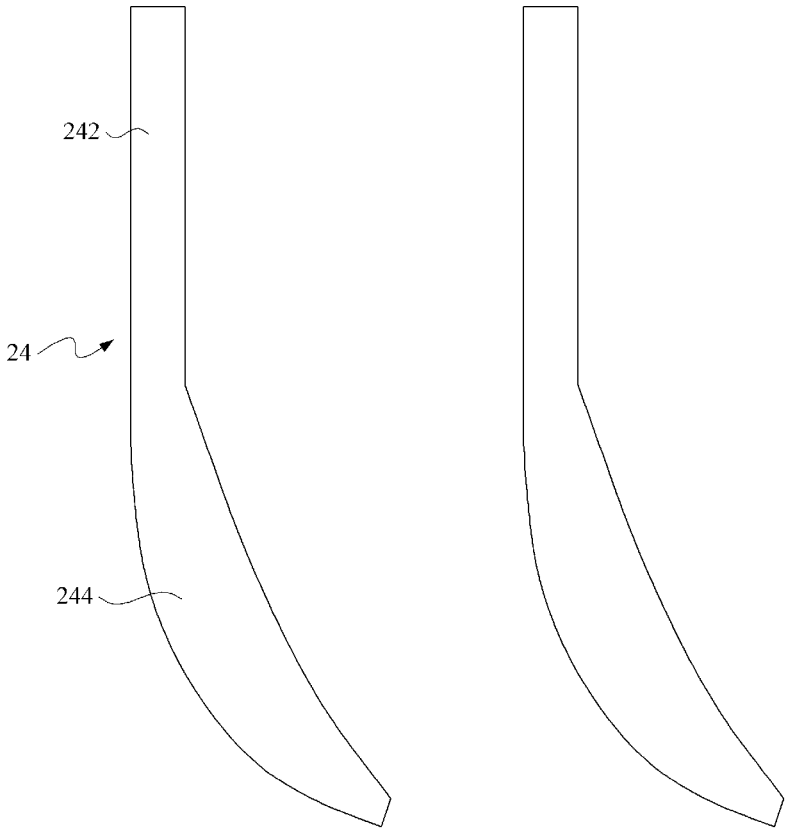
FIG. 6 is a schematic cross-sectional view of blades of a centrifugal fan in a circumferential direction, showing another embodiment of the centrifugal fan according to the disclosure.

FIG. 6 is a schematic cross-sectional view of blades of a centrifugal fan in a circumferential direction, showing another embodiment of the centrifugal fan according to the disclosure.

Compared with the case in the embodiment shown in FIG. 3, an air inlet of the centrifugal fan according to the embodiment is located on a lower side in the figure. A blade 24 includes a non-air guiding portion 242 and an air guiding portion 244. The air guiding portion 244 is connected to the non-air guiding portion 242, and is located below the non-air guiding portion 242.

Figure 7:
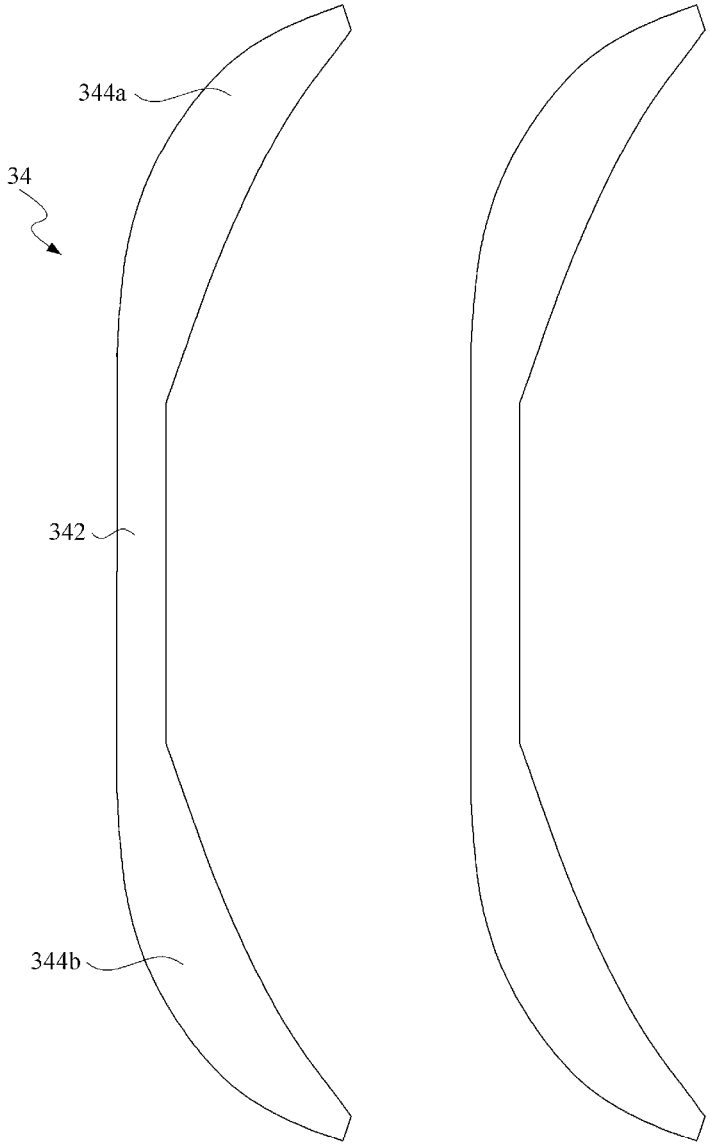
FIG. 7 is a schematic cross-sectional view of blades of a centrifugal fan in a circumferential direction, showing still another embodiment of the centrifugal fan according to the disclosure.

FIG. 7 is a schematic cross-sectional view of blades of a centrifugal fan in a circumferential direction, showing still another embodiment of the centrifugal fan according to the disclosure.

Compared with the case in the embodiment shown in FIG. 3, a blade 34 of the centrifugal fan according to the embodiment includes one non-air guiding portion 342 and two air guiding portions 344*a* and 344*b*. The two air guiding portions 344*a* and 344*b* are respectively located above and below the non-air guiding portion 342. The blade 34 is applicable to both an application environment in which the air inlet is located on the upper side and an application environment in which the air inlet is located on the lower side.

In an embodiment, the air guiding portions 344*a* and 344*b* of the blade 34 adopt a roughly the same but inverted line type, and are constructed in accordance with the method described in the foregoing FIG. 4A to FIG. 4D. The air guiding portions 344*a* and 344*b* are symmetric with respect to a rotational surface of the blade 34. The blade 34 presents a structure concave towards a right side (that is, a moving direction of the blade). However, the foregoing embodiments are not limited thereto. In other embodiments, according to the actual requirements, the air guiding portions 344*a* and 344*b* also adopt different line types for blade design.

Through the centrifugal fan 10 provided in the disclosure, the blades 14, 24, and 34 of the centrifugal fan respectively include the air guiding portions 144, 244, and 344*a* and 344*b* on sides of the blades facing the air inlet 112, and the air inflow channel 16 between the adjacent air guiding portions 144 is evenly expanded in the direction away from the air inlet 112. In this way, the airflow phenomenon at the air inflow channel 16 is effectively mitigated, to enhance the performance of the fan and reduce airflow noise.

The above is merely exemplary embodiments of the disclosure, and does not constitute any limitation on the disclosure. Any form of equivalent replacements or modifications to the technical means and technical content disclosed in the disclosure made by a person skilled in the art without departing from the scope of the technical means of the disclosure still fall within the content of the technical means of the disclosure and the protection scope of the disclosure.

What is claimed is:

1. A centrifugal fan, comprising:

an air inlet;

a shaft; and a plurality of blades, arranged around the shaft, wherein each of the blades includes an air guiding portion on a side of the blade facing the air inlet, the air guiding portion comprises a first curve and a second curve, and an air inflow channel is formed between the first curve and the second curve of two adjacent air guiding portions respectively, wherein a width of the air inflow channel is expanded in a direction away from the air inlet according to an expanding ratio, wherein the blade includes a non-air guiding portion, and the air guiding portion is connected to the non-air guiding portion, and wherein the air guiding portion includes a front edge and a rear edge, the front edge faces the air inlet, the rear edge is connected to the non-air guiding portion, and a thickness of the front edge is less than a thickness of the rear edge.

2. The centrifugal fan according to claim 1, wherein the expanding ratio is a fixed value.

3. The centrifugal fan according to claim 1, wherein the first curve is located on a leeward side of the blade, and the second curve is located on a windward side of the blade.

4. The centrifugal fan according to claim 1, wherein the non-air guiding portion includes a first straight line and a second straight line, the first straight line is connected to the first curve, and the second straight line is connected to the second curve.

5. The centrifugal fan according to claim 4, wherein the first straight line is parallel to the second straight line.

6. The centrifugal fan according to claim 1, wherein the air inflow channel has an entrance width and an exit width, and the width of the air inflow channel is increased to the exit width from the entrance width according to the expanding ratio.

7. The centrifugal fan according to claim 1, wherein the air guiding portion is located in a range of the air inlet.

* * * * *